United States Patent [19]

Angelico

[11] 4,429,451

[45] Feb. 7, 1984

[54] HAND TOOL FOR APPLYING ELECTRICAL CONNECTORS

[76] Inventor: Henry R. Angelico, 355 Fairwood Rd., Bethany, Conn. 06525

[21] Appl. No.: 225,855

[22] Filed: Jan. 16, 1981

[51] Int. Cl.[3] ..... H01R 43/04

[52] U.S. Cl. ..... 29/566.4; 7/131; 29/33 M; 29/751

[58] Field of Search ..... 29/566.4, 750, 751, 29/752, 278, 33 M, 566.1, 566.2, 566.3, 747, 748, 753, 566; 7/130, 131, 133, 134, 158

[56] References Cited

U.S. PATENT DOCUMENTS

| | | | |
|---|---|---|---|
| 318,006 | 5/1885 | Martin | 7/131 X |
| 799,737 | 9/1905 | Johnston . | |
| 1,858,418 | 5/1932 | Rowley . | |
| 2,590,031 | 3/1952 | Petersen | 7/133 |
| 3,662,449 | 5/1972 | Hashimoto . | |
| 3,903,725 | 9/1975 | Rommel . | |
| 4,006,502 | 2/1977 | Strickland . | |
| 4,009,514 | 3/1977 | Couto | 29/751 |
| 4,081,871 | 4/1978 | Knuth . | |
| 4,174,560 | 11/1979 | Senior et al. | 29/566.1 |
| 4,178,675 | 12/1979 | Phillips | 29/566.1 |

OTHER PUBLICATIONS

Western Electric Technical Digest No. 53, Jan. 1979, p. 15.

*Primary Examiner*—Z. R. Bilinsky

*Attorney, Agent, or Firm*—Prutzman, Kalb, Chilton & Alix

[57] ABSTRACT

A hand tool for applying telephone plugs to a telephone line and having a pair of pivotal handle members and a replaceably jaw module mounted between the handle members with a lower telephone plug support jaw thereof fixed within a transverse slot in the lower handle member and an upper telephone plug setting jaw thereof mounted for linear movement on the lower jaw and to be closed by cam actuation thereof by the upper handle member when the handle members are squeezed.

11 Claims, 6 Drawing Figures

HAND TOOL FOR APPLYING ELECTRICAL CONNECTORS

DESCRIPTION

1. Technical Field

The present invention relates generally to hand tools for applying electrical connectors and the like to an electrical line and more particularly, to a new and improved hand tool for applying specialized electrical connectors and having notable utility in securing telephone plugs to multiple lead telephone lines.

2. Background Art

The telephone industry employs several different types of small electrical connector plugs for connecting telephone hand sets and other telephone equipment having different numbers of telephone leads. For example, different types of electrical plugs are employed for (a) a four position hand set, (b) a two, three, four or six position line cord, and (c) an eight position line cord. For installing such electrical plugs, the telephone line is first prepared by cutting the line to the proper length, cutting and stripping any outer covering or conduit and inserting the prepared free end of the telephone line into the plug. The plug is then "crimped" to secure the plug to the telephone line and make electrical contact with the individual insulated wires of the telephone line.

DISCLOSURE OF INVENTION

In accordance with the present invention, a modular hand tool is provided for installing specialized electrical connectors, most notably electrical connector plugs of the type employed in the telephone industry.

It is a principal aim of the present invention to provide a new and improved telephone plug hand tool which can be easily operated in the field by a telephone equipment installer for securely attaching a telephone plug to a telephone line.

It is another aim of the present invention to provide a new and improved electrical connector hand tool which employs a specialized "crimping" jaw module for each type of telephone plug or other electrical connector. In accordance with the present invention, each of a plurality of special or custom jaw modules can be quickly and easily installed and replaced by a substitute module as a particular job may require.

It is a further aim of the present invention to provide a new and improved telephone plug installation tool which allows the installer to perform a combination of functions with a single tool and thereby eliminates the need for additional tools for preparing the telephone line for attachment of the plug.

It is another aim of the present invention to provide a new and improved electrical connector attachment tool which is of compact and ecomonical design and which is easily operated by an electrician for accurately securing an appropriate plug or other electrical connector to a multiple lead electrical line.

Other objects will be in part obvious and in part pointed out more in detail hereinafter.

A better understanding of the invention will be obtained from the following detailed description and the accompanying drawing of an illustrative application of the invention.

BEST MODE FOR CARRYING OUT THE INVENTION

Figure 1:
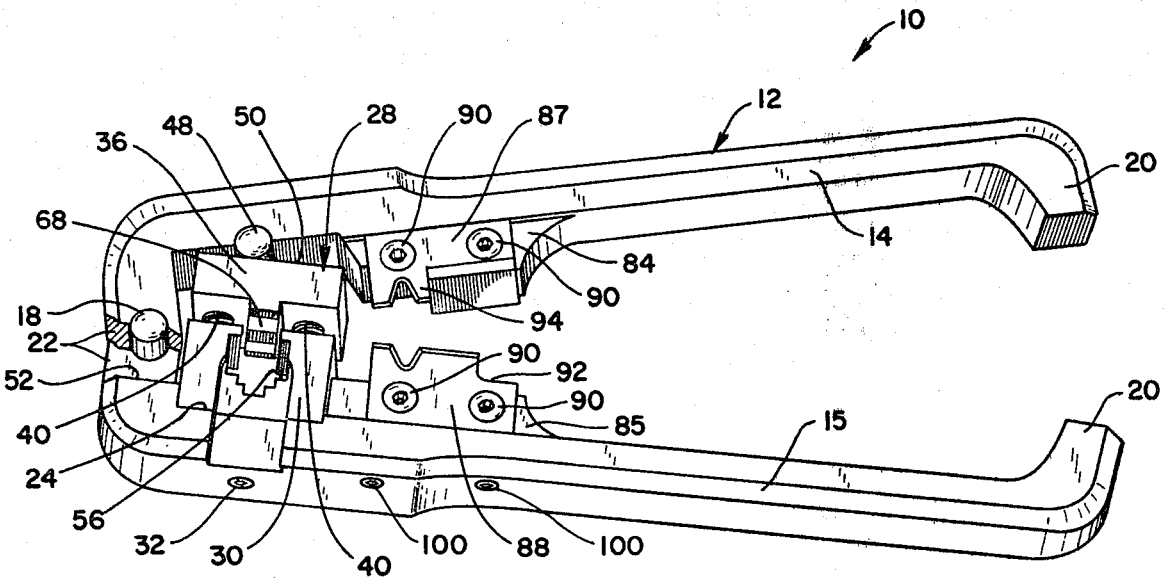
FIG. 1 is a perspective view, partly broken away and partly in section, of a telephone plug hand tool incorporating an embodiment of the present invention.
Figure 6:
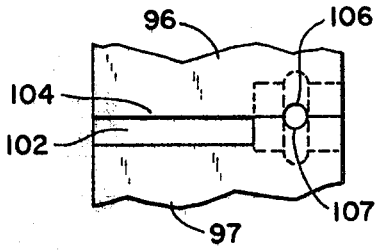
FIG. 6 is an enlarged partial side view, partly broken away, of the modified wire stripper and cutter.

Referring now to the drawings in detail wherein like numerals are used to identify like parts, a modular telephone plug hand tool 10 incorporating an embodiment of the present invention has a two-lever handle 12 which may be manually grasped by one hand for applying or attaching a telephone plug to a multiple lead telephone line. The handle 12 comprises a pair of opposed cast aluminum handle members or levers 14, 15 which are pivotally connected at their forward ends by a pivot pin 18 so that the handle members 14, 15 can be easily manually gripped in their open or withdrawn position shown in FIG. 1 and operated to their closed pivotal position at which their opposed inturned rear end abutments 20 remain out of engagement. The two handle members 14, 15 have respective right angle hinge legs or knuckles 22 at their forward or pivot ends which interfit for receiving the handle pivot pin 18.

The lower handle member 15 of the tool 10 as the tool is shown in the drawing and as the tool is normally held and manipulated, has an inner transverse slot or channel 24 at its forward end just rearwardly of the forward pivot pin 18. A jaw or die subassembly or module 28 is mounted between the opposed handle members 14, 15 within the transverse slot 24 of the lower handle member 15, and a lower support jaw or die 30 of the module is secured to the lower handle member 15 by a suitable threaded fastener 32 extending upwardly through an opening in the lower handle member. The jaw module 28 can be readily removed by removing the screw fastener 32 and sliding the jaw module 28 sidewise from between the two handle members 14, 15. A substitute or interchangeable jaw subassembly (not shown) can then be readily installed and secured in the transverse support slot 24 of the lower handle member 15 so that an appropriate jaw module can be employed for each specialized telephone plug or other electrical connector application. For example, the modular hand tool 10 can be used with a standard set of three different jaw modules (only one of which is shown) to be employed with a variety of different multiple lead telephone plugs now employed by the telephone industry.

An upper plunger jaw or setting die 36 of the jaw module 28 is mounted on two upstanding guide pins 38 of the lower support jaw 30 and is biased upwardly from the lower jaw by a pair of compression springs 40 surrounding the guide pins 38. The compression springs 40 also provide for opening the handle and are mounted within enlarged pockets 44 of the lower jaw to permit the handle to manually close the jaws. The jaw module 28 is manually held closed when installing the module 28 within the handle and a hard transverse cylindrical acutator pin 48 provided at the inner edge of the upper handle member 14 positioned to engage and slide across the upper flat surface 50 of the upper jaw 36 for holding the upper jaw 36 in position and for actuating it downwardly into operative engagement with the lower jaw 30 when the handle members 14, 15 are squeezed together. In the full open position of the handle shown in FIG. 1, the two depending legs 22 of the forward yoke of the upper handle member 14 engage the flat front face of the lower jaw 30 and/or an adjacent flat edge 52 of the lower handle member 15 to establish an open limit position of the handle. Also, in the full open position of the handle the upper jaw actuator pin 48 is forward of the transverse center line of the jaw module. As the handle is closed, the actuator pin 48 slides rearwardly along the upper flat surface 50 of the upper jaw 36 and the actuator pin 48 is substantially centered over the jaw 36 between the two guide pins 38 when the jaw module 28 is fully closed to apply the jaw closing force transmitted through the pin 48 evenly to a connector plug and in a direction parallel to the linear closing movement of the jaw module.

In operation, a telephone line plug, with pre-cut separately insulated leads of a telephone line inserted into the plug, is first inserted sidewise into a central locating pocket 56 provided in the lower jaw 30, and which pocket 56 is specially contoured and dimensioned for receiving and accurately aligning the particular plug under the upper jaw 36. The handle 12 is then squeezed to close the jaws on the inserted telephone plug to firmly secure or attach the plug to the telephone line.

Figure 2:
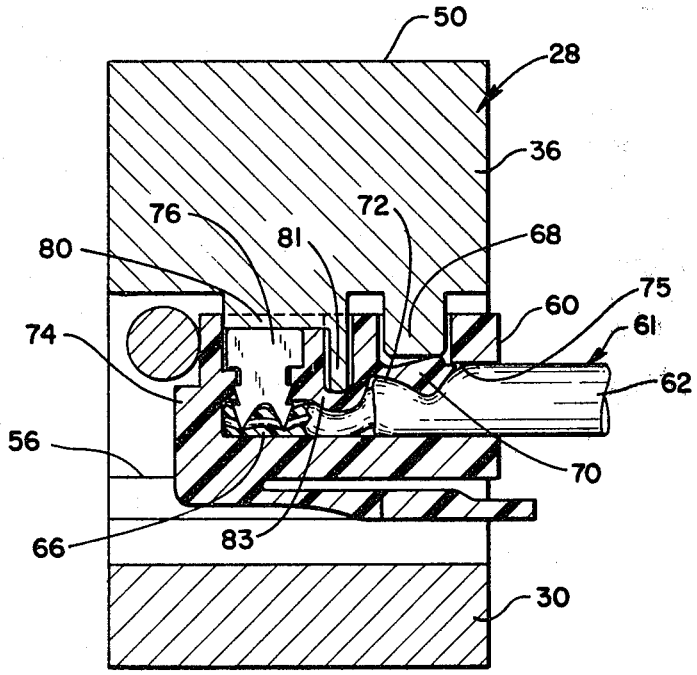
FIG. 2 is an enlarged transverse section view, partly broken away and partly in section, of a jaw module of the hand tool, additionally showing a telephone plug with a telephone line inserted therein, mounted within the jaw module.

With reference to FIG. 2, a conventional telephone line plug 60 of the type disclosed in U.S. Pat. No. 3,860,316 of E. C. Hardesty et al, dated Jan. 14, 1975, and for which the present invention has notable utility, is shown supported within the central locating pocket 56 of the lower support jaw 30 and with the telephone line or cord 61 inserted into the plug 60. A forward end portion of the outer cover 62 of the telephone line 61 is removed and the separate insulated leads 66 of the cord 61 are arranged in contiguous association in a predetermined order in accordance with their colored insulation before inserting the telephone line 61 into the plug 60. The central locating pocket 56 of the lower support jaw 30 is contoured and dimensioned to receive and locate the telephone plug 60 for proper alignment with the upper jaw 36 and so that a first inwardly projecting plunger 68 of the upper jaw 36 engages a generally V-shaped pivotal locking lever 70 of the telephone plug to pivot that lever downwardly into engagement with the telephone cord 61 to lock the cord 61 against withdrawal from the plug 60. The locking lever 70 has a thin plastic hinge section 72 connecting the locking lever to the rest of the integrally molded plastic plug body 74 and the locking lever 70 is sufficiently flexible to be wedged beneath an inner shoulder 75 of a rectangular cord opening in the plug body 74. The locking lever 70 is thereby retained in its fully depressed position shown in FIG. 2 in locking engagement with the telephone cord 61.

Figure 3:
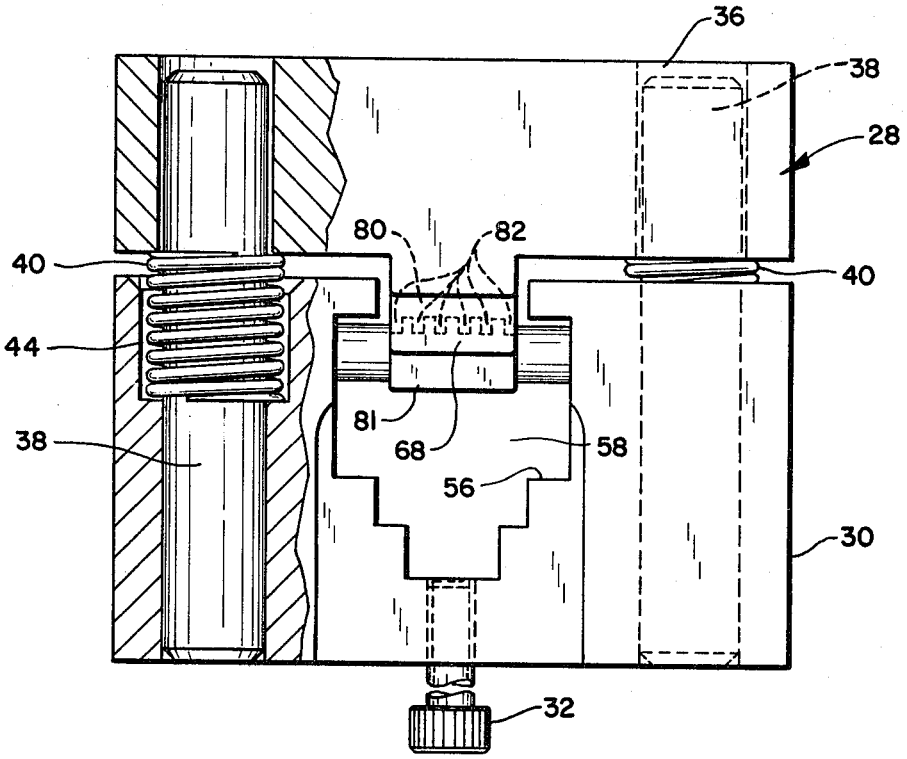
FIG. 3 is an enlarged side view, partly broken away and partly in section, of the jaw module.
Figure 4:
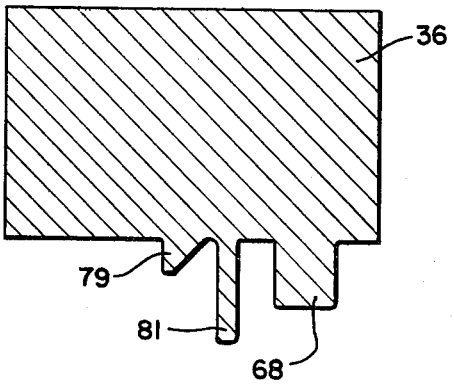
FIG. 4 is an enlarged transverse section view of a modified upper jaw of the jaw module.

A plurality of plug contact slides 76, one for each insulated lead 66, are depressed into electrical contact with respective insulated leads 66 of the telephone line 61 by a second plunger 80 of the upper jaw 36. The contact slides 76 are individually mounted within slots in the plug body 74 and are suitably held locked in their inner depressed positions by the plug body 74. The contact plunger 80 may be relatively wide and segmented as shown in FIGS. 2 and 3 to provide a separate plunger segment 82 for each contact slide 76 to depress the contact slides 76 below the upper edges of their supporting slots. Alternatively, a relatively narrow nonsegmented contact plunger 79 may be employed as shown in FIG. 4 to depress the contact slides 76 below the upper edges of the integral fins of the plug body 74 between the contact slides 76 and simultaneously swage or upset the upper edges of the intermediate fins over the contact slides 76 to lock the slides 76 in their inner depressed portions.

A third intermediate plunger 81 of the upper jaw 36 is engageable with an inner web 83 of the plug body 74 to deform that web 83 downwardly into engagement with all of the insulated leads 66 of the telephone cord 61 to lock the leads 66 in place. Thus, the specialized telephone plug jaw module 28 provides for fully securing the multiple contact telephone plug 60 to the telephone line or cord 61 is a single "crimping" step by gripping and squeezing the hand tool 10 after placing the plug 60 with the telephone line 61 properly inserted therein into the plug locating pocket 56 of the lower support jaw 30.

The hand tool 10 with a single jaw or die set module 28 is capable of installing a two, three, four and six position telephone line cord plug. An additional interchangeable module (not shown) which is dimensioned and contoured to accommodate for example a four position telephone hand set plug (not shown) or an eight position plug (not shown) can be readily substituted for the module 28 when the respective plug is to be installed.

Figure 5:
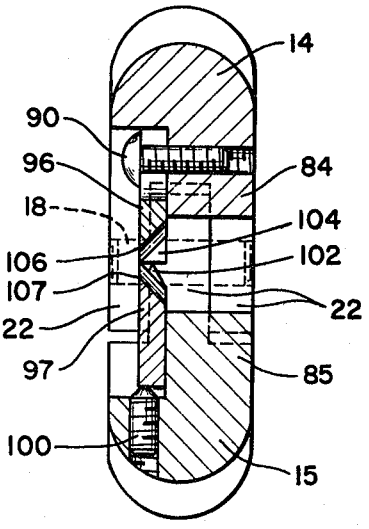
FIG. 5 is an enlarged transverse section view, partly broken away and partly in section, of a telephone plug hand tool having a modified wire stripper and cutter.

Also, the hand tool 10 allows the telephone installer to perform a combination of functions which eliminates the need for additional tools. For that purpose, the handle members 14, 15 are cast with a pair of opposed inwardly projecting mounting lugs 84, 85 rearwardly of the jaw module 28 for mounting a combined wire cutter and stripper. In the embodiment of the combined wire cutter and stripper shown in FIG. 1, a pair of flat plates or blades 87, 88 with inner cooperating contoured edges are secured by fasteners 90 to the side faces of the handle lugs 84, 85 to provide (a) a rear cutter 92 for cutting a telephone line to the desired length, and (b) a stripper 94 for cutting only the outer cord insulation or cover of the telephone line and for then stripping the cover from the inner insulated wires 66. In a second embodiment shown in FIG. 5, a pair of modified plates or blades 96, 97 are mounted on the lugs 84, 85 in essentially the same manner and in addition the lower plate 97 is accurately adjustably by a pair of longitudinally spaced set screws in the lower handle member 15 to properly abut the upper opposed plate 96 just before the jaw module 28 is fully closed. In that regard, the lower plate 97 has a forward central cutting edge section 102 which abuts a flat forward anvil edge section 104 of the lower plate 97 when the combined cutter and stripper is fully closed. Also, the upper and lower plates 96, 97 have rear contoured cutting edge sections 106, 107 which abut to provide a wire stripper for cutting and then stripping the outer cover of the telephone cord from the inner insulated wires 66. Solid, and/or stranded station wire, as well as flat or coiled tincel line cord may be stripped and cut and with the tincel wire cut clean and without frayed ends or hanging threads.

As will be apparent to persons skilled in the art, various modifications, adaptations and variations of the foregoing specific disclosure can be made without departing from the teachings of the present invention.

We claim:

1. A telephone plug hand tool for securing a telephone connector plug to a multiple lead telephone line, comprising a handle with a pair of opposed handle members having a pivot connection at a forward end thereof and hand operable toward each other for closing the handle, a unitary preassembled jaw module assembly detachably secured to the handle between said handle members just rearwardly of said pivot connection, said module being adapted for movement into and out of an open position for receiving a telephone connector plug and being adapted to be maintained in its preassembled condition during said movement into and out of said open position, said module including a telephone connector plug support jaw and an aligned connector setting jaw operatively associated for relative linear movement toward and away from said open position, jaw mounting means for mounting the jaws for relative linear movement thereof for opening and closing the jaw module and for detachably securing one of the jaws to one of the handle members, and biasing means for biasing the jaws apart as the handle members move apart, the support jaw having a contoured telephone plug connector locating pocket to locate and support a multiple lead telephone plug connector of established design in operative alignment with the connector setting jaw and the connector setting jaw being contoured for setting a said telephone plug connector mounted within the pocket of the support jaw to a multiple lead telephone cord upon closure of the jaw module, the other handle member having an actuator for sliding engagement with the other jaw for drivably closing the jaw module against the bias of the biasing means when the handle is closed.

2. A hand tool for securing a plurality of different specialized electrical connectors comprising a handle with a pair of opposed handle members having a pivot connection and hand operable toward each other for closing the handle, and a replaceable unitary preassembled jaw module assembly detachably secured between said handle members adjacent said pivot connection said module being adapted for movement into and out of an open position for receiving a specialized electrical connector and being adapted to be maintained in its preassembled condition during said movement into and out of said open position, said module having a specialized electrical connector support jaw and an aligned specialized connector setting jaw operatively associated for relative linear movement toward and away from said open position, jaw mounting means for mounting the jaws for relative linear movement thereof for opening and closing the jaw module and for detachably securing one of the jaws to one of the handle members, and biasing means for biasing the jaws apart, the support jaw having a contoured electrical connector locating pocket to locate and support a multiple lead electrical connector of established design in operative alignment with the connector setting jaw and the setting jaw being contoured for setting a said electrical connector mounted within the pocket of the support jaw to an electrical line upon closure of the jaw module, the other handle member having an actuator for engagement with the other jaw for drivably closing the jaw module when the handle members are closed.

3. A hand tool according to claim 1 or 2 further comprising opposed inwardly projecting electrical line cutting and stripping plates mounted on the handle members rearwardly of the jaw module to be engageably upon closure of the handle for respectively cutting and stripping an electrical line inserted therein.

4. A hand tool according to claim 3 further comprising set screw means for inwardly adjusting at least one of the plates.

5. A hand tool according to claim 3 wherein one of the opposed plates mounted on one of the handle members has a central cutting edge section at one end thereof and a first contoured stripper cutting edge section at the other edge thereof and wherein another opposed plate mounted on the other handle member has a flat anvil edge section opposed to and engageable by the cutting edge section for cutting an electrical line and a second contoured stripper cutting edge section opposed to and engageably the first contoured cutting edge section for cutting and then stripping the outer insulated cover of an electrical line.

6. A hand tool according to claim 1 or 2 wherein the setting jaw comprises a plurality of spaced plungers for engaging and setting a connector mounted within the pocket of the support jaw upon closure of the jaw module.

7. A hand tool according to claim 6 wherein one of the setting jaw plungers is an elongated contact setting plunger for depressing a plurality of laterally spaced contacts of a connector mounted within the pocket of the support jaw and for upsetting intermediate fins of a plastic connector body to hold the contacts in their depressed positions.

8. A hand tool according to claim 1 or 2 wherein the jaw module mounting means comprises guide means on one of the jaws for interconnecting the jaws for their said relative linear movement.

9. A hand tool according to claim 8 wherein the guide means comprises at least one guide pin, and wherein the biasing means comprises a compression spring mounted on the guide pin between the jaws for biasing the jaw apart.

10. A hand tool according to claim 1 or 2 wherein said actuator is a hard transversely extending pin.

11. A hand tool according to claim 1 or 2 wherein said one handle member has a transverse slot for said one jaw for detachably receiving said one jaw by inserting said one jaw sidewise therein.

* * * * *